United States Patent [19]

Landwehrkamp et al.

[11] Patent Number: 4,753,067

[45] Date of Patent: Jun. 28, 1988

[54] OPEN-END SPINNING MACHINE

[75] Inventors: Hans Landwehrkamp, Lenting; Eberhard Grimm, Ingolstadt, both of Fed. Rep. of Germany

[73] Assignee: Schubert & Salzer, Ingolstadt, Fed. Rep. of Germany

[21] Appl. No.: 845,241

[22] Filed: Mar. 28, 1986

[30] Foreign Application Priority Data

Apr. 2, 1985 [DE] Fed. Rep. of Germany ..... 3511953

[51] Int. Cl.[4] ..... D01H 7/882; D01H 1/16

[52] U.S. Cl. ..... 57/407; 57/88; 57/89; 57/92; 57/406; 57/408

[58] Field of Search ..... 57/406, 401, 407, 404, 57/408, 88, 89

[56] References Cited

U.S. PATENT DOCUMENTS

| | | | |
|---|---|---|---|
| 3,375,649 | 4/1968 | Bures et al. | 57/407 |
| 3,874,154 | 4/1975 | Stahlecker et al. | 57/407 |
| 4,059,947 | 11/1977 | Stahlecker | 57/407 |
| 4,105,265 | 8/1978 | Stahlecker | 57/406 X |
| 4,516,396 | 5/1985 | Stahlecker et al. | 57/407 |

*Primary Examiner*—John Petrakes

*Attorney, Agent, or Firm*—Dority & Manning

[57] ABSTRACT

In an open-end rotor spinning machine having a plurality of spinning stations located next to one another, each spinning station has a spinning rotor (40) which is arranged in a housing (1) and has a drive spindle (42) extending transversely to the machine longitudinal direction. This drive spindle (42) is mounted in the gusset portion of a supporting disk bearing (44). The supporting disk bearing (44) is supported by the housing (1) which accommodates the spinning rotor (40) and which is mounted on a swivelling axis (10). The spinning rotor (40) is driven by a drive belt (43) extending in the machine longitudinal direction. The housing (1) can be swivelled away from this drive belt (43) to such an extent that the housing (1) can be removed from its receptacle on the machine side.

19 Claims, 7 Drawing Sheets

OPEN-END SPINNING MACHINE

BACKGROUND AND SUMMARY OF THE INVENTION

The present invention relates to an open-end rotor spinning machine having a plurality of spinning stations which are located next to one another and have one spinning rotor each which is arranged in a housing, located in a receptacle on the machine side, and has a drive spindle which extends transversely to the machine longitudinal direction and by means of which it is driven by a drive belt extending in the machine longitudinal direction, with the drive spindle being mounted in the gusset portion of a supporting disk bearing. A device of this type is known from the German Offenlegungsschrift No. 2,515,783, which corresponds to U.S. Pat. No. 4,105,265.

The spinning rotor runs at high speed, so that its bearing is subjected to relatively high wear and therefore has to be replaced from time to time. This wear is intensified when the spinning rotor is out of balance.

With this in view, the housing accommodating the spinning rotor is dismantled to make the supporting disk bearing accessible and subsequently to make it possible to likewise dismantle the latter. When dismantling and installing the supporting disk bearing there is the risk of the supporting disk continuing to rotate or coming in contact with the drive belt and being positively driven. This involves a risk of injury for the operator, so that the entire machine always has to be stopped for safety reasons for the individual dismantling and installing of a housing.

The object of the present invention is therefore to avoid these disadvantages in a generic open-end spinning machine and to create a simple device in which the rotor bearing can be replaced without risk when the machine is running.

This object is achieved according to the invention in that the supporting disk bearing is supported by the housing which accommodates the spinning rotor and which is mounted on a swivelling axis and can be swivelled at least so far away from the drive belt that the housing can be removed from the receptacle on the machine side. By swivelling the housing, the supporting disk bearing is at the same time lowered beneath the drive belt or raised above the drive belt to such an extent that the supporting disks are released from the drive belt and can be removed out of the receptacle beneath the drive belt or over the drive belt. This can be done by a rectilinear or curved movement of the housing with the supporting disk bearing attached to it or also by continuing the swivelling movement first initiated, in which case the housing can be detached from the receptacle by slackening a locking mechanism or screw connection, etc.

It is possible to mount and to install and dismantle the rotor housing independently of a second housing accommodating the delivery element and the opening element. On the other hand, rolls can form at both the delivery element and the opening element, which rolls lead to damage of the latter. This can also be the case if the spinning device is not operated properly. When there are faults of this nature, it is also necessary to replace the damaged parts. According to a further feature of the invention, to be able to replace the rotating spinning elements of a spinning device without risk when the machine is running, the housing which accommodates the drive spindles with the drive whorls or drive wheels and which accommodates both the opening and the spinning elements can be swivelled as a whole about the swivelling axis and out of its receptacle on the machine side. According to the invention, this can also be implemented in such a way that the second housing is connected to the rotor housing and can be swivelled together with the latter.

To be able to swivel the housing accommodating the spinning rotor and parts fixed to the housing out of the receptacle on the machine side, for example to make the supporting disk bearing accessible for maintenance purposes, etc., without removing the housing from the machine, provision can be made in a further embodiment of the invention for the machine parts which are in a fixed position relative to the swivellable housing and parts attached to the latter and which are located in the swivelling area of the swivellable parts to have a minimum distance from the swivelling axis, which minimum distance is greater than the maximum distance of the parts to be swivelled past these machine parts. This ensures that the housing, with all the parts supported by it, can be swivelled out of the machine frame without obstruction by drive means, brakes, etc., so that the drive spindle and also the supporting disk bearing can be inspected visually. The drive spindle is separated from its drive belt by the swivelling movement of the housing and removed to such an extent that the elements rotatably mounted in the housing cannot be driven again momentarily even unintentionally during the subsequent dismantling. The elements attached to the housing can therefore be inspected without risk to the operator even when the machine is running. In addition, both the complete housing accommodating the spinning rotor and parts of the housing can be dismantled or installed or even replaced when the machine is running, so that the other spinning stations can continue to operate undisturbed.

In a further advantageous embodiment of the inventive object, provision can be made in the case of delivery and opening elements arranged approximately at the same distance from the swivelling axis for the maximum distance of a drive spindle of the opening element from the swivelling axis to be at least just as great as the minimum distance of the drive means of the delivery element from the swivelling axis, and for the maximum distance of this drive spindle from an imaginary vertical plane located between the swivelling axis and the drive means to be smaller than the minimum distance of these drive means from this plane. In this case, too, the housing can be swivelled for the purpose of inspection, maintenance or replacement without risk to the operator.

According to an embodiment which is simple in construction, the drive means of at least one of the rotating elements are arranged in a channel-like jacket which extends over a plurality of spinning stations located next to one another and which supports the swivelling axes of the housing of these spinning stations and one longitudinal side of which is covered by this housing. This channel makes possible a compact and low-noise design of the device according to the invention.

In such an embodiment of the inventive object, the channel-like jacket, at its side remote from the swivelling axis, preferably terminates at a minimum distance from the swivelling axis, which minimum distance is greater than the maximum distance of the drive spindle and/or the supporting disk bearing from the swivelling axis. Within the meaning of the present invention, the term "bearing" also includes, if necessary, lubricating devices for such a bearing. At the same time, the side of the channel-like jacket, which faces toward the drive means for the opening and delivery elements, preferably terminates between these drive means and is at the same time made as a mounting element for the drive means of the opening and/or delivery elements.

The inventive object can also be used in conjunction with a dirt separating device. So that it is not necessary to release and later set up again any connecting lines between the housing and a dirt removal device when the housing is being swivelled, provision is made according to a particularly advantageous embodiment for the housing, which is mounted on the swivelling axis with its upper end which accommodates the spinning element, to have a dirt separating opening on its lower side. Such dirt separating opening leads away from the opening element and has guiding walls extending parallel to the swivelling. The maximum distance of such guiding walls and the maximum distance of the drive spindle of the delivery and opening elements from the swivelling axis are at least just as great. A dirt removal belt is guided beneath the housing in an upwardly open guide channel, the side walls of which extend towards the guiding walls and the minimum distance of which from the swivelling axis is greater than the maximum distance of the guiding walls from the swivelling axis. In this way, the side walls of the guide channel do not obstruct swivelling movements of the housing but nevertheless extend up to the immediate proximity of the guiding walls of the dirt separating opening. As a result of this, the separated dirt safely reaches the dirt removal belt without the risk of fly building up in the spinning machine.

In an expedient embodiment of the invention, the guide channel is fixed to the channel-like jackets which support the housings of several spinning stations located next to one another.

Inspecting the drive spindles and their mountings is made all the easier the further they are removed from one another. Nevertheless, in order to obtain a compact arrangement of the driven elements and also a fiber feed channel which is as short as possible and gently guides the fibers, the drive spindles of the delivery element and the opening element (designed as an opening cylinder) have such an inclination relative to the drive spindle of the spinning rotor and the opening cylinder is arranged relative to the spinning rotor in such a way that the fiber feed channel leading from the opening cylinder to the spinning rotor is arranged and made symmetrical to the center radial plane passing through the opening cylinder.

It is common practice to provide a housing which accommodates a spinning rotor with a swivellable cover and to provide a brake linkage which is mounted in a fixed position and can be brought into its braking position by swivelling the cover. To enable one or more of the rotating elements to be stopped on the one hand by the swivelling of the cover closing the housing, but so that this is also possible when the cover is located in the closed position, the brake linkage preferably has a control arm which can be actuated independently of the position of the cover. In this way, when the cover is closed, a spinning station can be controlled for cleaning the spinning rotor and/or for piecing manually or automatically, for example from a piecing trolley.

To eliminate unintentional swivelling of the housing, a locking device is provided which secures the housing in its operating position and is accessible only after the cover is swung aside.

In a further embodiment of the inventive object, so that both hands can be free for inspection and maintenance work, a locking device is advantageously provided which secures the housing in its maintenance position.

Moreover, a valve which can be controled as a function of the swivelled position of the housing can expediently be provided in the vacuum line to the housing. This automatically ensures that no vacuum loss can occur at this spinning station when the housing is swivelled or removed.

The present invention enables the driven elements of each spinning station to be inspected in a simple and reliable manner without the entire spinning machine having to be stopped for the protection of the operator. The operator is also protected during installation and dismantling of a housing. This simplicity in design and this safety for the operator is accompanied by a higher production during this inspection and maintenance phase, because the adjacent spinning stations can continue to operate normally without impairing the spinning station to be inspected or maintained.

BRIEF DESCRIPTION OF THE DRAWINGS

The invention is described in greater detail below with reference to several exemplary embodiments, in which.

DETAILED DESCRIPTION OF THE PREFERRED EMBODIMENTS

Figure 2:
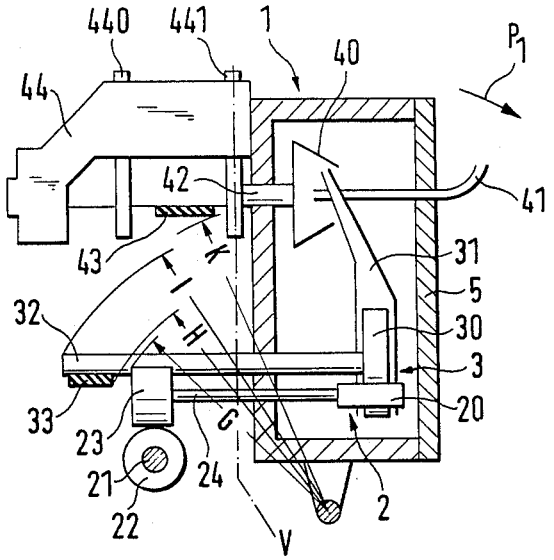
FIG. 2 shows a diagrammatic sectional view of a second design of a spinning station designed according to the invention.

The principle of the invention is first described with reference to FIG. 1. As is apparent from this figure, each spinning station has an individual housing 1 which is swivellably mounted at its upper end on a swivelling axis 10. The swivelling axis 10 is mounted in a holder 12, supported by the machine frame 11, and extends in the machine longitudinal axis.

The housing 1 accommodates a delivery device 2, an opening device 3 and also a spinning element 4, eg. spinning rotor 40. Of the delivery device 2, only a delivery element designed as a delivery roller 20 is shown in FIG. 1, whereas the opening device 3 shown has an opening element designed as an opening cylinder 30.

A fiber feed channel 31 extends from the opening cylinder 30 into the inside of the spinning rotor 40. In addition, a thread withdrawal tube 41 which is supported by a cover 5 leads from the inside of the spinning rotor 40 and out of the housing.

The delivery roller 20 is driven by a drive shaft 21 which extends in the machine longitudinal direction via a plurality of spinning stations located next to one another and carries, per spinning station, a worm gear 22 with which a worm gear 23 is in engagement. This worm gear 23 is located on the end of a drive spindle 24, on the other end of which is mounted the delivery roller 20.

The opening cylinder 30 is located on the end of a drive spindle 32, the other end of which, in its operating position, bears against a drive belt 33. The spinning rotor 40, too, is supported by a drive spindle 42, the free end of which, in its operating position, bears against a drive belt 43.

Figure 1:
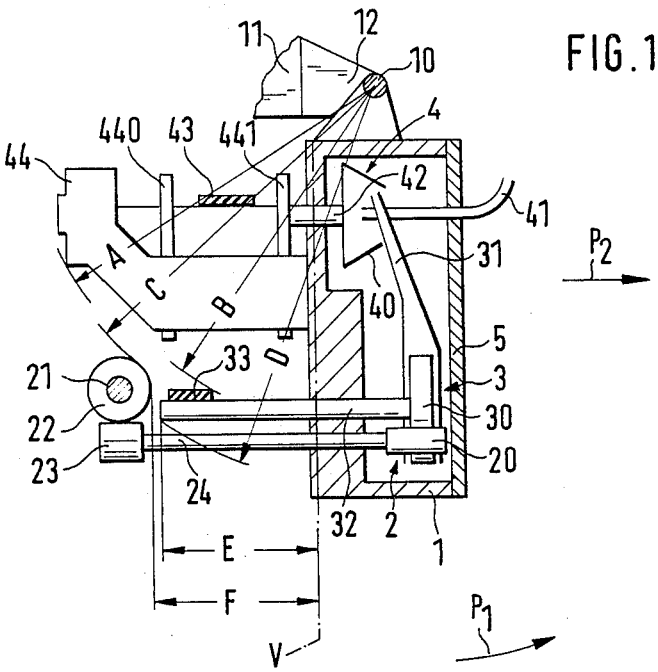
FIG. 1 shows a diagrammatic sectional view of a first design of a spinning station designed according to the invention.

The spinning rotor 40 is mounted in the gusset portion of a supporting disk bearing 44 which, according to the exemplary embodiment shown in FIG. 1, has two pairs of supporting disks 440 and 441. The supporting disk bearing 44 is attached to the rear of the housing 1 and can therefore be swivelled together with the latter.

The spinning machine, of which the construction of a spinning station has been described above, works in conventional manner. A sliver (not shown) is supplied by means of the delivery device 2 to the opening cylinder 30, is opened by the latter into individual fibers and supplied in this form through the fiber feed channel 31 to the collecting groove of the spinning rotor 40 and deposited there in the form of a fiber ring. While the fiber ring is being continuously bound, a thread produced in the spinning rotor 40 is drawn off through the thread withdrawal tube 41 and out of the spinning rotor 40 and is wound onto a reel (not shown).

As FIG. 1 shows, the drive spindles 24, 32 and 42 extend transversely to the machine longitudinal direction and, at different distances from the swivelling axis 10, come into contact with their drive means (worm gear 22, drive belt 33 and drive belt 43).

The housing 1 is fixed in its spinning position in a way not shown, for example by means of screws. If the supporting disk bearing is now to be made accessible for the purposes of maintenance, replacement, etc., the fixing means of the housing 1 are slackened and this housing 1 is swivelled in the direction of arrow $P_1$. Moreover, the drive spindle 42 is released from the drive belt 43. At the same time, the drive spindle 32 moves away from the drive belt 33 and the worm gear 23 moves away from the worm gear 22. If the housing 1 is swivelled to the extent that the supporting disks 440 and 441 can no longer stay on the drive belt 43 when being drawn forward, the housing 1 is removed from the swivelling axis 10 in the direction of arrow $P_2$ in a way not shown (for example, swivelling a bearing bracket, eg. recess 100 according to FIG. 5 in the swivelling axis 10, etc.). At the same time, the supporting disk bearing 44 is pulled through beneath the drive belt 43. The supporting disk bearing 44 can now be supplied with fresh oil or maintained in another manner. It is likewise possible to maintain the delivery roller 20 and the opening cylinder 30 and their bearings. The adjacent spinning stations are not impaired in any way by this removal and subsequent replacement of the housing 1 and continue to operate undisturbed. During the installation and dismantling, the cover 5 of the housing 1 is closed. During the installation and dismantling of the housing 1, therefore, the operator comes in contact with all the elements mounted on and in the housing 1 but does not come in contact with any of the drive means and therefore is not endangered at any time by the latter or by the elements driven by them.

FIG. 1 shows an embodiment of the device described, in which the supporting disk bearing 44 alone can be made accessible by being swivelled out of the machine, in which case the housing 1 can then also be removed from the machine if need be.

Despite the varying distance of the drive means from the swivelling axis 10 of the housing 1, in order to avoid the drive spindles 24, 32, and 42 being able to come in contact with any of these drive means (worm gear 22, drive belts 33 and 43) when the housing is swivelled, the supporting disk bearing 44 and the drive spindles 24, 32 and 42 and also the drive means in the embodiment shown are in a fixed arrangement relative to one another. Thus the maximum distance A of the drive spindle 42 of the spinning rotor 40, which drive spindle 42 is located nearest to the swivelling axis 10, and the supporting disk bearing 44 of the spinning rotor 40 from the swivelling axis 10 is smaller than the minimum distance of the drive means not allocated to the spinning rotor 40 from the swivelling axis 10, namely than the minimum distance B of the drive belt 33 and the minimum distance C of the drive shaft 21 from this swivelling axis 10.

In the exemplary embodiment shown, the maximum distance D of the drive spindle 32 of the opening cylinder 30 from the swivelling axis 10 is in fact greater than the minimum distance C of the worm wheel 22 on the drive shaft 21 from the swivelling axis 10. However, instead of this the drive spindles 32 and 24 are essentially the same distance from the swivelling axis 10. Moreover, the maximum distance E of the drive spindle 32 from an imaginary vertical plane V between the swivelling axis 10 and the drive means (worm gear 22, drive belts 32 and 43) is smaller than the minimum distance F of the worm gear 22 from this imaginary plane V.

By maintaining the abovementioned distances, the housing 1, together with the elements (delivery device 2, opening device 3 and spinning element 4 eg. spinning rotor 40) mounted in the housing 1, can be swivelled about the swivelling axis 10 and out of the machine without the drive means (worm gear 22 and drive belts 33 and 43) being an obstruction when doing so. In this way, the supporting disk bearing 44 in particular becomes accessible.

These dimensional relationships must not only be maintained with regard to the drive means arranged in the machine independently of the housing 1, but also with regard to other elements independent of the housing 1 provided they are located on the side of the drive spindles 42, 32 and 24 which is remote from the swivelling axis 10. This ensures that the swivelling movement of the housing 1 is not impaired by these elements. Such an element can be, for example, a brake which interacts with one of the driven elements. In this connection, this can also be a supporting roller 61 and 63 (FIG. 3) for one of the drive belts 43 or 33.

In a modified exemplary embodiment shown in FIG. 2, the arrangement of the rotatable elements (spinning rotor 40, opening device 3 and delivery device 2) in the housing 1 has not been changed relative to that according to FIG. 1, but the housing is mounted at its lower end on the swivelling axis 10. The swivelling axis 10 is therefore located on the end of the housing 1, which end is remote from the spinning rotor 40. In this exemplary embodiment, the maximum distance G of the worm gear 23 on the drive spindle 24 arranged nearest to the swivelling axis 10 from the latter is smaller than the minimum distances H and K of the drive belts 33 and 34 not allocated to this drive spindle 24. Moreover, the maximum distance I of the drive spindle 32 from the swivelling axis 10 is smaller than the minimum distance K of the drive belt 43 from this swivelling axis 10. Here, too, the housing 1 can be swivelled (arrow $P_1$) unimpaired toward the operating side, with the operating side being arranged to the right of the imaginary vertical plane V in both FIG. 1 and FIG. 2.

In the embodiments shown in FIGS. 1 and 2, the drive spindles 32 and 42 have in each case come directly in contact with their drive belts 33 and 43. As a departure from the embodiments shown, one or both of the drive spindles 32 and 42 can carry a whorl with which these drive spindles 32 and/or 42 come in contact with the drive belts 33 and/or 43. The dimensional relationships specified then of course refer to the whorl if its distance from the swivelling axis 10 is greater than the distance of the drive end of the drive spindle 32 or 42 from the swivelling axis 10.

Further modifications are possible by interchanging features or by replacing them by equivalents and combinations hereof. Thus it is also conceivable to arrange the delivery device 2 and the opening device 3 in the upper part and the spinning rotor 40 in the lower part of the housing 1 if the material flow, in contrast to the exemplary embodiments shown, is from top to bottom.

Figure 3:
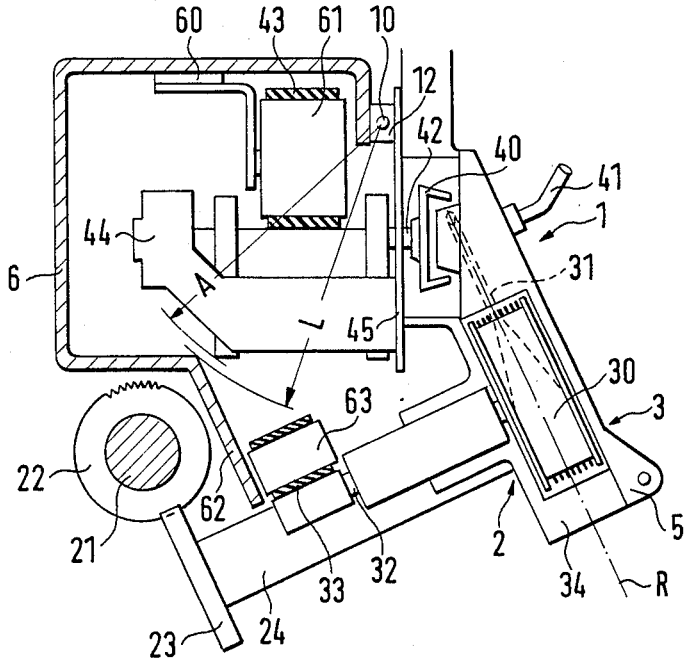
FIG. 3 shows a section of an exemplary embodiment of the design of the inventive object shown schematically in FIG. 1.

FIG. 3 shows an exemplary embodiment of the device schematically shown in FIG. 1. In this case, care has been taken to ensure that the maximum distance A of the supporting disk bearing 44 for the drive spindle 42 of the spinning rotor 40, which supporting disk bearing 44 is fixed to the housing 1, from the swivelling axis 10 is smaller than the minimum distance B of the drive means for the opening device 3 and the delivery device 2 (FIG. 1).

As shown in FIG. 3, the drive means (drive belt 43) are arranged in a channel-like jacket 6 which extends over a plurality of spinning stations located next to one another. Between the drive spindles 42 of the spinning rotors 40 of adjacent spinning locations, the jacket 6 in each case carries a holder 60 for supporting rollers 61 for the drive belt 43. Also in an arrangement of the swivelling axis 10 according to FIG. 2, the holder 60 and the supporting roller 61 are therefore located laterally displaced outside the swivelling area of the parts which can be swivelled with the housing 1.

The holders 12 for the swivelling axes 10 of the housings 1 of the individual spinning locations, which swivelling axes 10 extend in the machine longitudinal direction, are also attached to the jacket 6. The channel-like jacket 6 is covered towards the operating side essentially by the housings 1 of the adjacent spinning locations.

In the exemplary embodiment shown, the lower side 62 of the channel-like jacket 6 faces toward the drive means (drive belt 33 and also drive shaft 21 with worm gear 22) of the opening device 3 and the delivery device 2 and terminates between these drive means. The minimum distance L of this side 62 from the swivelling axis 10 is greater than the maximum distance A of the drive spindle 42 and the supporting disk bearing 44 for the spinning rotor 40 from this swivelling axis 10. Thus the housing 1 can be swung out of jacket 6 unimpaired through the side 62.

The channel side 62 is made as a holding element for supporting rollers 63 for the drive belt 33 of the opening cylinder 30. These supporting rollers 63 are located between the drive spindles 32 of adjacent spinning locations and therefore generally lie outside the swivelling area of the drive spindle 42 and the supporting disk bearing 44 for the spinning rotor 40. Otherwise, provision is to be made for the minimum distance B (FIG. 1) of these supporting rollers 63, just as that of the drive belt 33, to be greater than the maximum distance A of the drive spindle 42 and the supporting disk bearing 44.

According to the device shown in FIG. 3—in contrast to the embodiments shown in FIGS. 1 and 2—the fiber feed channel 31 is symmetric to the center radial plane R passing through the opening cylinder. This has particular advantages for the conveyance of the fiber. In order to make this design of the fiber feed channel 31 possible, the drive spindles 24 and 32 of the delivery device 2 and the opening device 3 are appropriately inclined relative to the drive spindle 42 of the spinning element 4. In this way, as clearly shown by FIG. 3, the delivery device 2 and the opening device 3 are located close to the spinning rotor 40, so that the conveyance path of the separated fibers is short. On the other hand, however, the drive spindles 24 and 32 are relatively far removed from the drive spindle 42 with its bearing 44, which substantially simplifies the inspection and maintenance of these parts.

Figure 4:
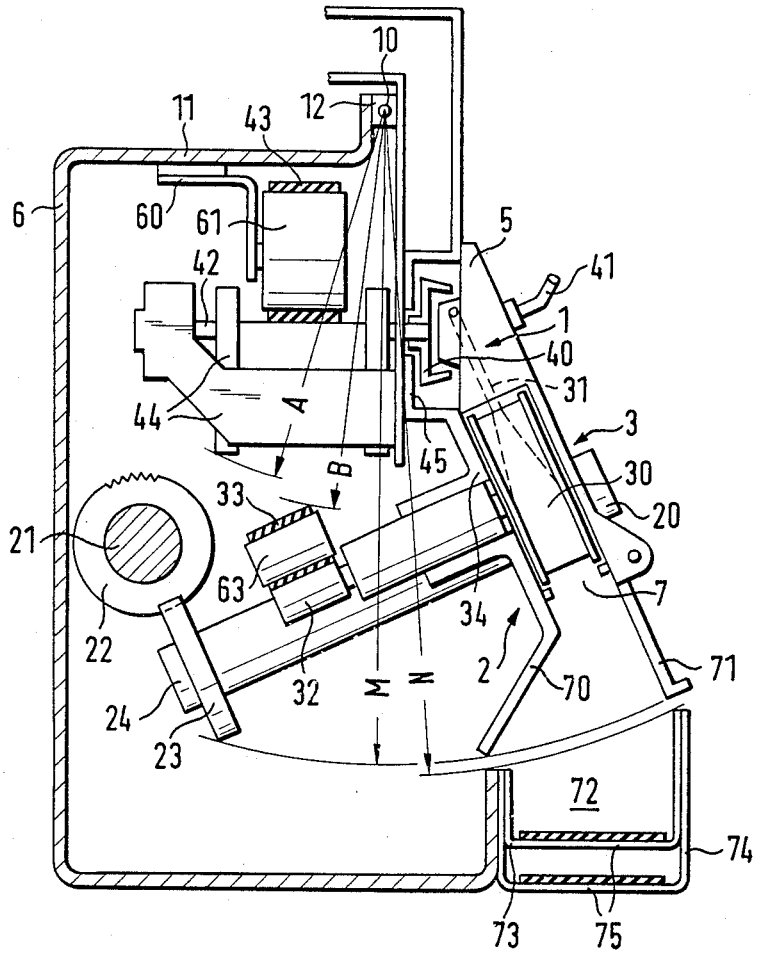
FIG. 4 shows a section of a modification of the device shown in FIG. 3, in conjunction with a dirt separating device.

FIG. 4 shows a further modification of the device described. The housing 1, which accommodates both the spinning rotor 40 and the delivery device 2 and the opening device 3 as in the embodiments shown in FIGS. 1 to 3, has a dirt separating opening 7 on its lower side, which dirt separating opening 7 leads away from the opening cylinder 30 and is screened by two guiding walls 70 and 71 extending in the machine longitudinal direction. The maximum distance M of these guide walls 70 and 71 from the swivelling axis 10 is at least just as great as the maximum distance M of the drive spindle 24 and the worm gear 23 sitting on it from the swivelling axis 10.

The channel-like jacket 6, which in this exemplary embodiment accommodates the drive means (drive shaft 21, and also drive belts 33 and 43) of all elements (delivery roller 20, opening cylinder 30, spinning rotor 40) rotatably mounted in the housing 1, extends up to below the housing 1 and supports an upwardly open guide channel 72. The two strands of a dirt removal belt 75 are guided in this guide channel 72. The guide channel 72 is defined by two side walls 73 and 74 which extend in the machine longitudinal direction and come up close to the guiding walls 70 and 71. However, the minimum distance N of these side walls 73 and 74 from the swivelling axis 10 is slightly greater than the maximum distance M of the guiding walls 70 and 71 and also the worm gear 23 on the drive spindle 24 from this swivelling axis 10. This ensures during production that the dirt separated at the opening cylinder 30 is reliably guided onto the dirt removal belt 75, but that on the other hand swivelling the housing 1 together with the supporting disk bearing 44 for the purposes of inspection, maintenance or replacement is not impaired.

The preferred embodiment of the device already described with reference to various exemplary embodiments is explained with the aid of FIGS. 5 and 6. In this device, the front plate 13 of the housing 1 is swivellably mounted by means of the swivelling axis 10 between two screening plates 110 of the machine frame. A vacuum line 15 leads from the housing 1 to a collecting line (not shown) extending in the machine longitudinal direction. Located in this vacuum line 15 is a valve 16 which can be controlled as a function of the swivelled position of the housing 1. For this purpose, each holder 12 carries a limit switch 17 which is actuated in the operating position of the housing 1 by the front plate 13 and is released from its operating position when the housing 1 is swivelled. If the housing 1 is not located in its operating position but assumes its maintenance position or is even dismantled, the vacuum line 15 is consequently blocked by the valve 16; vacuum loss at this location is therefore avoided.

Allocated to the housing 1 is a locking device 14, from which the arm of a lever 140 extends through an opening 131 in the front plate 13 of the housing 1 to the cover 5. The lever 140 is swivellably mounted on the housing 1 and can engage into a restraining mount (not shown), which is supported in a fixed position by the machine frame, or can disengage from it.

The housing 1 is held in its operating position by the locking device 14, in which operating position all elements (delivery roller 20, opening cylinder 30 and spinning rotor 40) rotatably mounted in it are in drive connection with their drive means (worm gear 22 and also drive belts 33 and 43). To reliably eliminate unintentional swivelling of the housing 1, the lever 140 is accessible only after the cover 5 has been swung out. Thus the cover 5 must first be opened before the housing 1 is swivelled.

The cover 5 is mounted on the housing 1 by means of a swivelling axis 50 extending in the machine longitudinal direction. The cover 50 has a stop 51 with which it comes in contact with the front plate 13 of the housing 1 when being swung out and therefore limits the swivelling movement of the cover 5.

An angle-piece 18 with an opening 180 is provided on the front plate 13, into which opening 180 a catch lever 52 engages with its catch projection 520 in the closed position of the cover 5. The catch lever 52 is swivellably mounted on the cover 5 and is acted upon by a spring 53. For swinging out the cover 5, this catch projection 520 is disengaged from the opening 180 by the exertion of pressure on the arm 522 of the catch lever 52, which arm 522 is remote from the catch projection 520. If the cover 5 is moved back into its closed position, the catch projection 520, with its leading bevel 521, runs on to the angle-piece 18 and engages into the opening 180 by the action of the spring 53.

Figure 5:
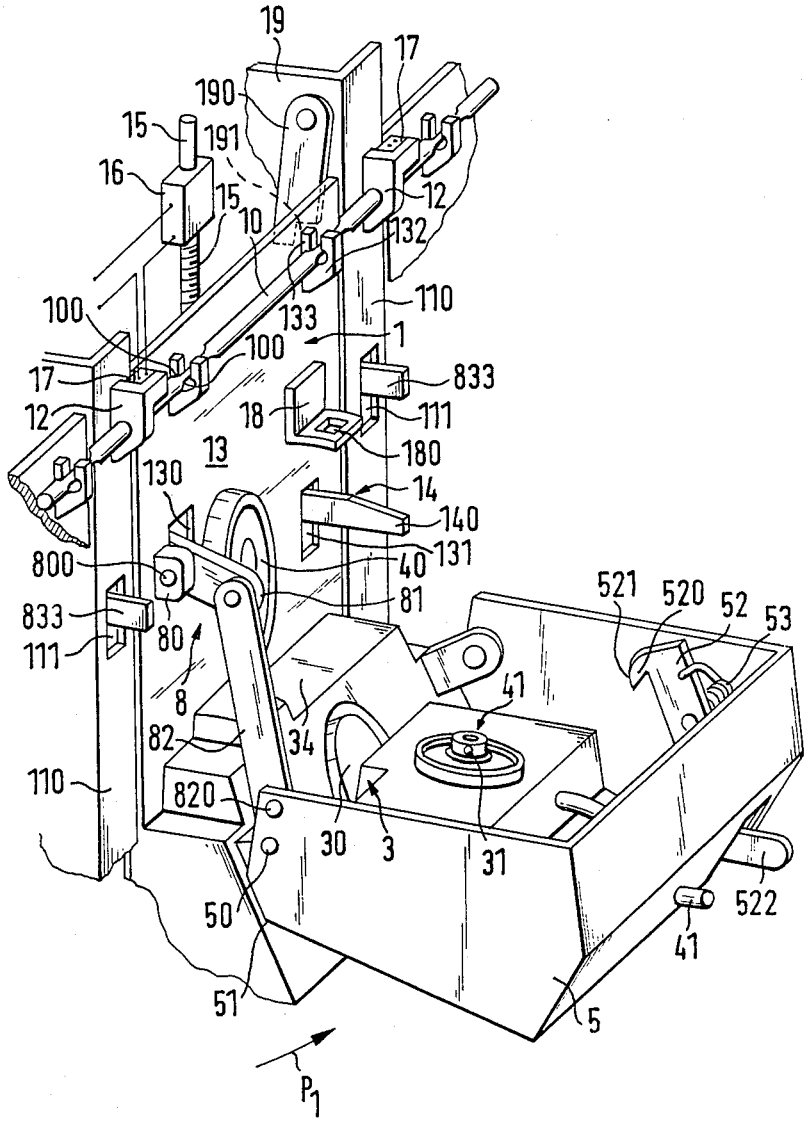
FIG. 5 shows a perspective view of a further modification of a spinning station designed according to the invention.
Figure 6:
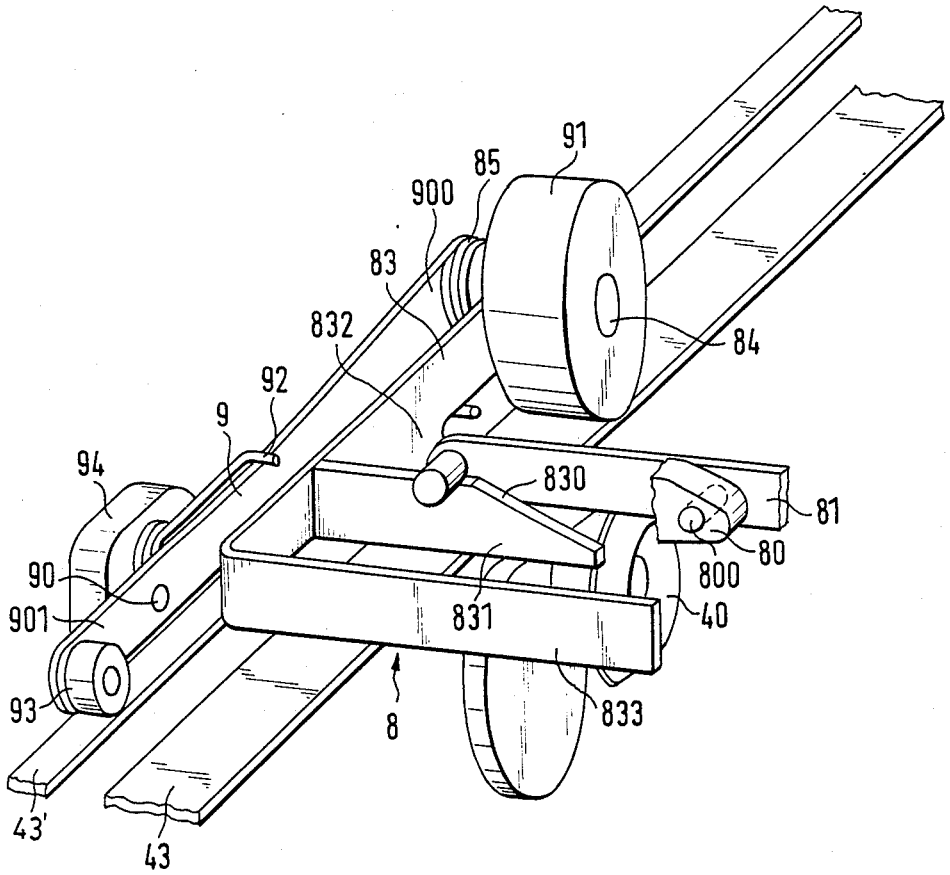
FIG. 6 shows a detail of the device shown in FIG. 5.

In order to stop the spinning rotor 40 and possibly a further rotating element such as, for example, the opening cylinder 30 when the cover 5 is being swung out, a brake linkage 8 is provided according to the exemplary embodiment shown in FIGS. 5 and 6. For this purpose, a bearing 80 is provided on the housing 1, which bearing 80, by means of a pin 800, supports a swivelling lever 81 which, at its end facing toward the cover 5, is connected in articulated manner to a coupling member 82. The coupling member 82 is articulated by means of a pin 820 on the cover 5 in such a way that swivelling the cover 5 causes the swivelling lever 81 to swivel. This swivelling lever 81 projects from the side of the front plate 13, which side faces toward the cover 5, through an opening 130 up to the rear side of the front plate and—as shown in FIG. 6—supports a roller 810 on its free end, which roller 810 rests on a ramp-like surface 830 of a brake lever 83. The brake lever 83 extends in the machine longitudinal direction and is swivellably mounted on a stationary axis 84 independently of the housing 1. With a stop 832, it is held in contact by a torsion spring 85 with the underside of a roller lever 9. The stop 832 is made as the receptacle of a brake insert (not shown) which is brought into contact with drive spindle 42 (see FIG. 1) of the spinning rotor 40 during braking.

The ramp-like surface 830 of the brake lever 83 is part of a control arm 831 which extends essentially perpendicular to the machine longitudinal direction toward the operating side, that is toward the cover 5.

The roller lever 9 is rotatably mounted on a stationary swivelling axis 90 and, at one of its ends, supports a roller 91 by means of the axis 84, which roller 91, by actuating the brake lever 83, can be brought into contact with the drive belt 43 or lifted from the latter. Supporting rollers (not shown) are located between the spinning stations in conventional manner beneath the drive belt 43, which supporting rollers lift the drive belt 43 from the drive spindle 42 of the spinning rotor 40 when the drive belt 43 is released by the roller 91. On the other hand, if the roller 91 is again brought into contact on to the drive belt 43, the drive belt 43 again moves into driving contact with the drive spindle 42 of the spinning rotor 40.

If the cover is swung out after being released by the catch lever 52, the swivelling lever 81 is likewise swivelled via the coupling member 82. At the same time, the roller 810 moves onto the surface 830 of the control arm 831 and in doing so lifts the stop 832 from the roller lever 9. The brake insert arranged in the stop 832 comes in contact with the drive spindle 42 of the spinning rotor 40 and consequently stops the latter.

As shown by FIG. 6, the two control arms 831 and 833 are arranged between the swivelling axis 90 of the roller lever 9 and axis 84. As a result of this, when the cover 5 is swung out further, in which case the brake lever 83 is also swivelled further, the contact surface of the brake insert on the drive spindle 42 of the spinning rotor 40 becomes the new swivelling axis for the brake lever 83, so that the roller 91 is also lifted from the drive belt 43 during this further swivelling movement of the cover 5.

The roller lever 9 is acted upon by a torsion spring 92. The consequence of this is that, when the cover 5 is swung up—when the roller 810 releases the control arm 831 of the brake lever 83 again—the roller lever 9 brings the roller 91 into contact again with the drive belt 43, while the brake lever 83, with its stop 832, comes in contact with the underside of the roller lever 9. In this way, the drive spindle 42 of the spinning rotor 40 is released by the brake insert of the brake lever 83 and driven again by the drive belt 43.

If required, a brake linkage for the opening cylinder 30 can also be provided in the same or similar manner.

Since the driven elements (spinning rotor 40, supporting disks 440 and 441, opening cylinder 30 and delivery roller 20), or at least the high-speed elements among them, are stopped as soon as the cover 5 is swung out, these elements are already stationary before the start of the swivelling movement of the housing 1 released by the lever 140, so that even inadvertent contact with these elements does not endanger the operator.

So that it is not necessary to keep hold of the housing 1 during inspection or maintenance of the elements mounted in the housing 1 without dismantling the latter, a second locking device 19, in the embodiment shown in FIG. 5, is allocated to the housing 1, which locking device 19 secures the housing 1 in the maintenance position. The locking device 19 has a latch 190 which is articulated on the screening plate 110 and has a ratchet-like recess 191 into which the front plate 13 of the housing 1 engages when being swung up. In this position, it is not only possible to inspect the parts mounted in or on the housing 1, in particular the supporting disks 440 and 441 of the supporting disk bearing 44, but if necessary they can also be individually dismantled or installed or even exchanged for other parts. The oil level in the supporting disk bearing 44 can also be checked and if necessary adjusted by refilling.

To be able to remove the housing 1 from the machine in a simple and quick manner, the following arrangement is made. The swivelling axis 10 is mounted in the holders 12 such that it is secured against rotation. The front plate 13 carries two holders 132 with which it, and therefore the housing 1, is mounted on the swivelling axis 10. The two holders 132 in each case have a radial slot 133 leading upward from their bore accommodating the swivelling axis 10, which radial slot 133 is narrower than the diameter of the swivelling axis 10, so that the housing 1 is securely mounted on the swivelling axis 10. In the area of the two holders 132, the swivelling axis 10 has two recesses 100, located diametrically opposite one another, to such an extent that the swivelling axis 10 in this area has a narrow cross-sectional area. The recesses 100 are arranged such that the front plate 13 now has to be swivelled out of its operating position shown in FIG. 5 by more than 90°, that is beyond the maintenance position, until the holders 132 can be removed from the swivelling axis 10.

As mentioned above, the housing 1 can only be unlocked after the cover 5 has been swung out, during which the rotating elements in the housing 1 are stopped. If the housing 1, after it has been unlocked by means of the lever 14, is swung up in a forward direction, the drive spindles 24, 32 and 42 of these elements are removed from all drive means without there being the risk of the drive spindles and supporting disks 440 and 441 coming into contact with any of the drive means. There is therefore no risk of injury to the operator as a result of inadvertently driven elements in the housing 1.

However, despite the swivelling capacity of the housing 1 and the actuation of brakes by means of a brake linkage 8, the conventional braking independently of a movement of the housing 1 need not be dispensed with. Thus it is also the task of the second control arm 831 of the brake lever 83 to be able to control the spinning rotor 40 independently of an outward swivelling movement of the cover 5. This can be done manually or by means of a maintenance and/or piecing device (not shown) which can be moved along the machine.

A rotor speed which is less than the production speed is expedient for piecing. According to FIG. 6, a second drive belt 43' is therefore provided parallel to the drive belt 43, which drive belt 43' is driven at a lower speed than the drive belt 43 and can be brought into contact with the drive spindle 42 of the spinning rotor 40 by means of a roller 93. For this purpose, the roller lever 9 in the embodiment shown, is designed as a balance lever which supports the roller 91 and the brake lever 83 on its one arm 900 and the roller 93 on its other arm 901. The swivelling axis 90 of the roller lever 9 is arranged in a fixed position in the machine by means of a bearing 94. So that the swivelling capacity of the housing 1 is not impaired, the roller lever 9 and brake lever 83 are located on the same side of the drive spindle 42 of the spinning rotor 40 as the drive belts 43 and 43'.

Since the control arm 833 of the brake lever 83 is located between the swivelling axis 90 of the roller lever 9 and the axis 84, the roller 91 can be lifted from the drive belt 43 for the piecing by the exertion of pressure on the control arm 833 from below, and the roller 93 can be brought to bear on the drive belt 43'. At the same time, the drive belt 43 releases the drive spindle, 42 of the spinning rotor 40, while the drive belt 43' comes into contact with this drive spindle 42 and therefore drives the spinning rotor 40 at reduced speed.

The embodiments described show that, by swivelling the housing 1, together with the supporting disk bearing 44 flanged on it, the supporting disks 440 and 441 can be removed upward or downward from the drive belt 43 or from the drive belts 43 and 43' to such an extent that the supporting disks 440 and 441, when the housing 1 is removed, no longer come in contact with the drive belts 43 or with the drive belts 43 and 43'. Moreover, it does not matter whether the housing 1 is simply pulled out forward (arrow $P_2$) after release from the swivelling axis 10, or whether the swivelling movement of the housing 1 is continued (arrow $P_1$) until the supporting disk bearing 44 is accessible even without releasing the housing 1 from the swivelling axis 10. Nor is the special design of the supporting disk bearing 44, for example with one or two pairs of supporting disks, of decisive importance for the device described.

Figure 7:
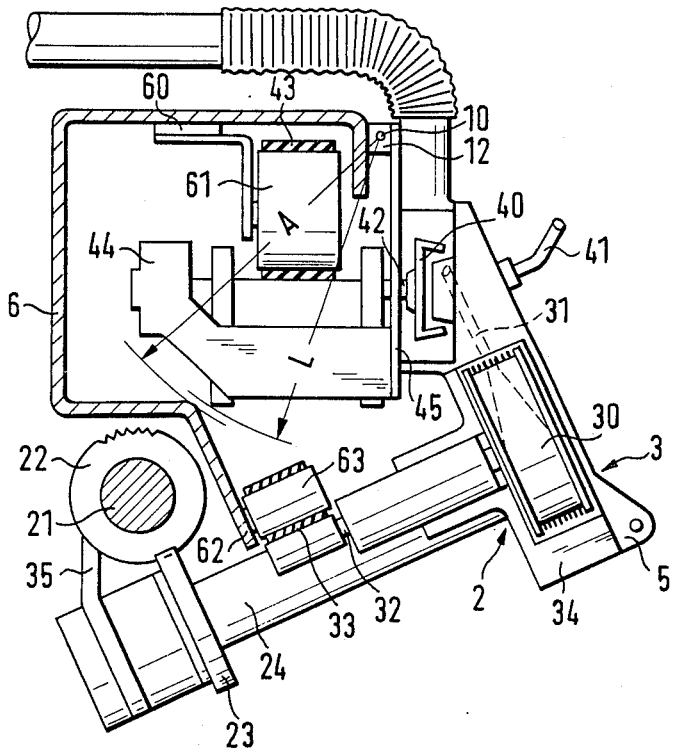
FIGS. 7 and 8 show a sectional view of a modified embodiment of the inventive device in its spinning or maintenance position.
Figure 8:
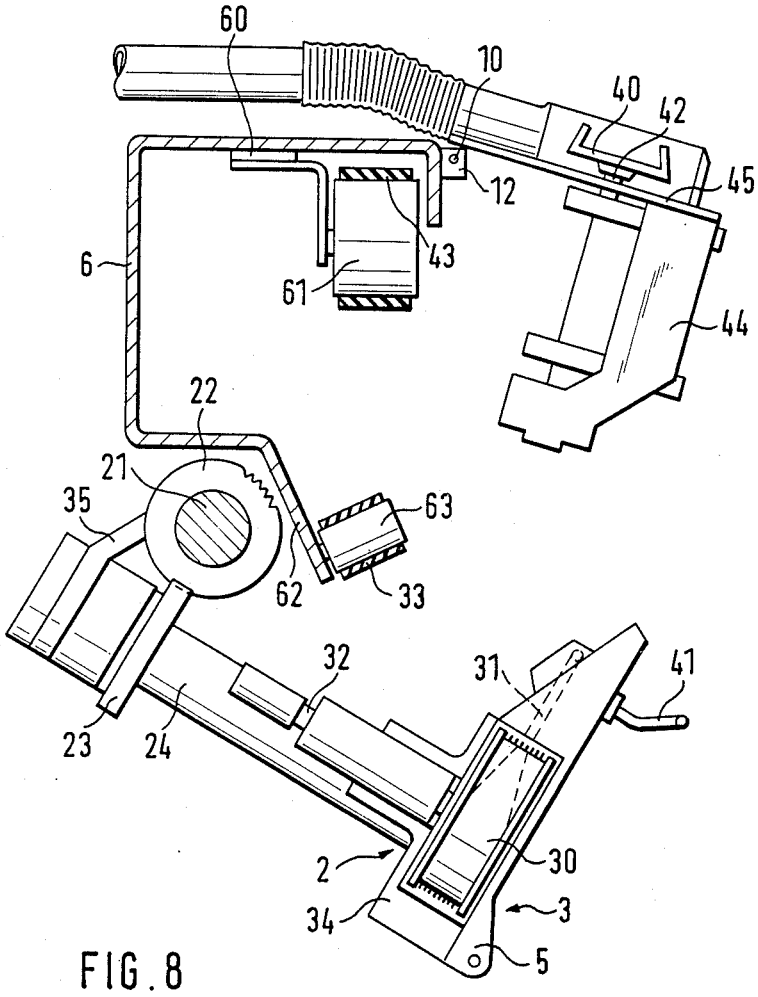

According to the illustrations shown, the supporting disk bearing 44 is attached on a housing 1 which accommodates both the spinning rotor 40 and also the delivery device 2 and the opening device 3. As shown by FIGS. 7 and 8, separate housings 45 and 34 can also be provided, of which the first housing 45 accommodates the spinning rotor 40 and the second housing 34 accommodates the delivery device 2 and the opening device 3. These housings 45 and 34 can be rigidly connected to one another, so that, by swivelling them together, all of the driving and driven elements of a spinning station become accessible.

According to FIGS. 7 and 8, the two housings 45 and 34 are mounted independently of one another. In this arrangement, the (rotor) housing 45 is swivellably mounted on a swivelling axis 10, whereas the housing 34 is swivellably mounted on the drive shaft 21 for the delivery roller 20 by means of a mounting element 35 (FIG. 7). The housing 34 and the cover 5 are kept in contact with the rotor housing 45 by elastic means (not shown).

If the supporting disk bearing 44 is to be inspected or if, for example, the running behavior of one of the drive belts 43 or 33 is to be checked, the rotor housing 45 is in turn swivelled out of the machine. To make this possible, the housing 34, together with all of the devices (delivery device 2, opening device 3, cover 5) mounted in or on it, is in this case first lowered to such an extent that the rotor housing 45 can be swivelled forward. Here, too, all of the driving and driven elements of a spinning station can be inspected in this manner without endangering the operator, in which case removal of the housings 45 and/or 34 can even be dispensed with, depending on the swivelling area provided for the housings 45 and 34 and on the element to be inspected. FIG. 8 illustrates both housings 45 and 34 swivelled outward for inspection and/or maintenance or the like of various elements which were previously covered by such housings, as illustrated by application FIG. 7.

We claim:

1. An open-end spinning machine, having a plurality of spinning stations located next to one another with one spinning element and respective housing therefor for each station, such stations being generally located in a receptacle along one side of the machine, at least one drive belt extending in the machine longitudinal direction, a supporting disk bearing at each station, each supporting disk bearing being supported by its respective housing for movement therewith, and a drive spindle for each respective spinning element mounted in a gusset portion of each respective supporting disk bearing thereof for pivoting movement therewith on said housing, wherein each housing is mounted on a swivelling axis for swivelling away from said drive belt for interrupting drive of said spinning element thereby, and for continued swivelling by an amount adequate to remove said housing from said receptacle so that such housing, together with its respective supporting disk bearing and spinning element, can be safely inspected, maintained, or removed from said machine.

2. A machine as in claim 1, further comprising a delivery and an opening element arranged in a second housing at each respective station, said second housing being connected to said spinning element housing for being swivelled therewith.

3. A machine as in claim 2, wherein the maximum distance of a drive spindle for said opening elements from said swivelling axis is about the same as the minimum distance of a drive means for said delivery element from said swivelling axis, and wherein the maximum distance of such drive spindle from an imaginary plane located between such swivelling axis and such drive means is smaller than the minimum distance of such drive means from such plane.

4. A machine as in claim 2, wherein:

said spinning element housing is mounted on said swivelling axis, and wherein said housing on a lower side thereof has a dirt separating opening which leads away from said opening element and has guiding walls extending parallel to said swivelling axis, with the maximum distance of the drive spindle for said delivery and opening elements from said swivelling axis being at least just as great as the maximum distance of said guiding walls therefrom; and wherein a dirt removal belt is guided beneath said housing in an upwardly open guide channel therefor, side walls of which extend toward said guiding walls and the minimum distance of which from said swivelling axis is greater than the maximum distance of said guiding walls from said swivelling axis.

5. A machine as in claim 4, wherein said guide channel is fixed to said channel-like jacket which supports several housings for spinning stations located next to one another.

6. A machine as in claim 1, wherein portions of said machine in a fixed position relative to said swivellable housing are located predetermined minimum distances respectively from the swivelling axis of such housing, which minimum distances are each greater than the respective maximum distances which said supporting disk bearings and associated drive spindles are swivelled past such machine portions, whereby said bearings, spindles, and associated housings are freely pivotable relative said machine and said receptacle thereof.

7. A machine as in claim 1, further comprising a delivery and an opening element, and a channel-like jacket which extends over a plurality of spinning stations located next to one another and which supports swivelling axes of housings of such spinning stations, and wherein a drive means for at least one of the rotatable elements such as the delivery element, opening element, or spinning element is engaged within such jacket, one longitudinal side of which is essentially covered by such housing.

8. A machine as in claim 7, wherein said channel-like jacket, at a side thereof remote from said swivelling axis, terminates at a minimum distance from such swivelling axis, which minimum distance is greater than the maximum distance of both said drive spindle and said supporting disk bearings, respectively, from said swivelling axis.

9. A machine as in claim 8, wherein a side of said channel-like jacket which faces toward drive means for said opening and delivery elements terminates between such drive means, and serves as a mounting element for such drive means.

10. A machine as in claim 1, further comprising a delivery and an opening element, and wherein drive spindles of said delivery element and said opening element comprising an opening cylinder have such as inclination relative to the drive spindle of said spinning element and said opening cylinder is arranged relative to said spinning element in such a way that a fiber feed channel leading from said opening cylinder to said spinning element is symmetrical to a center radial plane passing through said opening cylinder.

11. A machine as in claim 1, further comprising a delivery and an opening element, and further comprising a swivellable cover for said housing, and a controllable brake linkage for braking at least one of said rotating elements including such as said delivery element, said opening element or said spinning element, which brake linkage is mounted in such a fixed position so as to be brought into an operative braking position thereof by swivelling actuation of said cover, and wherein said brake linkage further has a control arm which can be actuated independently of the position of said cover, for also bringing said linkage into its braking position.

12. A machine as in claim 1, further comprising a swivellable cover for said housing, and wherein said swivellable cover for said housing includes a locking device for securing said housing in a defined operating position thereof, said locking device being accessible for actuation only after said cover has been swivelled in a defined outward and open direction.

13. A machine as in claim 12, further comprising an additional locking device for securing said housing in a defined maintenance position thereof.

14. A machine as in claim 1, further including a vacuum line connected to said housing, with a valve disposed in said vacuum line for controlling same as a function of the swivelled position of said housing.

15. An open-end spinning machine, including:

a plurality of spinning devices located next to one another with one housing each, which housing is mounted on a swivelling axis oriented in a machine longitudinal direction and which accommodates respective rotating delivery, opening, and spinning elements for swivelling movement with their respective housing, drive spindles for said respective elements, received for swivelling movement therewith, which spindles extend transversely to said machine longitudinal direction and which, at differing distances from said swivelling axis, may be coupled with drive means for selectively engaging and driving said spindles, said drive means extending over the length of said machine and mounted thereon independently of said swivelling housing, wherein said housing, accommodating said drive spindles and drive whorls or wheels therefor, may be swivelled as a whole about said swivelling axis and out of a receptacle therefor on a given side of said machine, by an initial amount so as to simultaneously disengage said drive spindles from said drive means and by a further amount to provide access to the interior of said housing for inspection and maintenance thereof.

16. A machine as in claim 1, wherein said spinning element comprises a spinning rotor.

17. An open-end rotor spinning machine, comprising:

a plurality of individual spinning stations disposed adjacent one another in succession along said machine;

a plurality of rotatable spinning rotors associated respectively one each with each of said stations;

a common drive means extending along said plurality of spinning stations for providing drive power thereto;

a plurality of housings associated respectively one each with each of said rotors for respectively enclosing same, each such housing adapted for respective pivoting movement;

drive spindle means for controllably transmitting drive power between said common drive means and respective of said opening rotors, portions of said drive spindle means being associated with said respective housings for movement therewith;

rotor bearing means for supporting said respective spinning rotors for rotation, portions of said rotor bearing means being associated with said respective housings for movement therewith;

pivot means adapted for pivoting selected ones of said housings, inclusive of respective spinning rotors, drive spindle means portions, and rotor bearing means portions associated therewith, so as to automatically interrupt drive power being transmitted to the respective rotors thereof from said common drive means, and to further pivot said housings to provide access to the interior thereof, whereby said spinning stations may be selectively inspected and maintained one at a time without interrupting operation of any other station of said machine and without risking harm to an operator;

locking means for controllably and selectively securing said respective housings in defined closed, operative positions thereof;

a plurality of pivoting covers with integral braking mechanisms for protecting the respective housings and their associated locking means, wherein a given locking means may be exposed for actuation by pivoting its respective cover into a defined open position, which pivoting automatically actuates the respective braking mechanism of such cover to brake the respective spinning rotor of such housing, whereby a safety feature is provided such that a housing cannot be unlocked by an operator until its respective spinning rotor has been stopped.

18. A machine as in claim 17, wherein said pivot means include swivelling axes mounted at an area located either relatively above or relatively below said housing, for providing a pivot for same.

19. An open-end rotor spinning machine, comprising:

a plurality of individual spinning stations disposed adjacent one another in succession along said machine;

a plurality of rotatable spinning rotors associated respectively one each with each of said stations;

a common drive means extending along said plurality of spinning stations for providing drive power thereto;

a plurality of rotor housings associated respectively one each with each of said spinning rotors for respectively enclosing same, said spinning motors mounted with respect to said rotor housings for movement therewith;

rotor bearing means, portions thereof respectively received on said rotor housings for movement therewith, for rotatably supporting said spinning rotors;

drive spindle means for controllably transmitting drive power between said common drive means and respective of said spinning rotors, portions of said drive spinkle means being associated with said respective spinning rotors and their respective rotor housings for movement therewith;

pivot means adapted for pivoting selected ones of said rotor housings, inclusive of their respective spinning rotors, drive single means portions, and rotor bearing means portions, so as to automatically interrupt drive power being transmitted to the respective spinning rotors thereof from said common drive means, whereby said spinning stations may be selectively inspected and maintained one at a time without interrupting operation of any other station of said machine and without risking harm to an operator;

a plurality of delivery and opening device pairs, one each of said pairs being associated respectively with one of said stations; and a plurality of further housings associated respectively one each with each of said delivery and opening device pairs; wherein said drive spindle means further controllably transmit drive power from said common drive means to said delivery and opening device pairs; and further wherein said further housings are pivotally mounted, either independently of or in association with said rotor housings, for selectively interrupting drive power to said delivery and openings device pairs and exposing said device pairs for safe inspection and maintenance thereof.

* * * * *